United States Patent [19]

Proud et al.

[11] 4,063,132

[45] Dec. 13, 1977

[54] DC POWERED MICROWAVE DISCHARGE IN AN ELECTRODELESS LIGHT SOURCE

[75] Inventors: Joseph M. Proud, Wellesley Hills, Mass.; Richard A. Bessett, Derry, N.H.; William H. McNeill, Carlisle, Mass.

[73] Assignee: GTE Laboratories Inc., Waltham, Mass.

[21] Appl. No.: 711,743

[22] Filed: Aug. 4, 1976

[51] Int. Cl.[2] ..... H05B 41/16; H05B 41/24

[52] U.S. Cl. ..... 315/248; 315/267; 315/39

[58] Field of Search ..... 315/248, 267, 39

[56] References Cited

U.S. PATENT DOCUMENTS

| | | | |
|---|---|---|---|
| 3,484,619 | 12/1969 | Proud, Jr. | 315/39 X |
| 3,600,712 | 8/1971 | Williamson | 315/39 |
| 3,705,319 | 12/1972 | Goldie et al. | 315/39 |
| 3,790,852 | 2/1974 | Bolin et al. | 315/267 |
| 3,826,950 | 7/1974 | Hruda et al. | 315/267 |
| 3,873,884 | 3/1975 | Gabriel | 315/267 |
| 4,002,943 | 1/1977 | Regan et al. | 315/248 |

*Primary Examiner*—Saxfield Chatmon, Jr.

*Attorney, Agent, or Firm*—Irving M. Kriegsman; Leslie J. Hart; Fred Fisher

[57] ABSTRACT

A half wavelength resonant cavity having inner and outer coaxial conductors is coupled at one end to a dc power source, and a gas discharge electrodeless lamp is disposed in the region between the conductors at the other end of the cavity. Repetitive bursts of radio frequency oscillations occur within the cavity, the oscillations causing breakdown of the fill material within the lamp to produce light.

6 Claims, 1 Drawing Figure

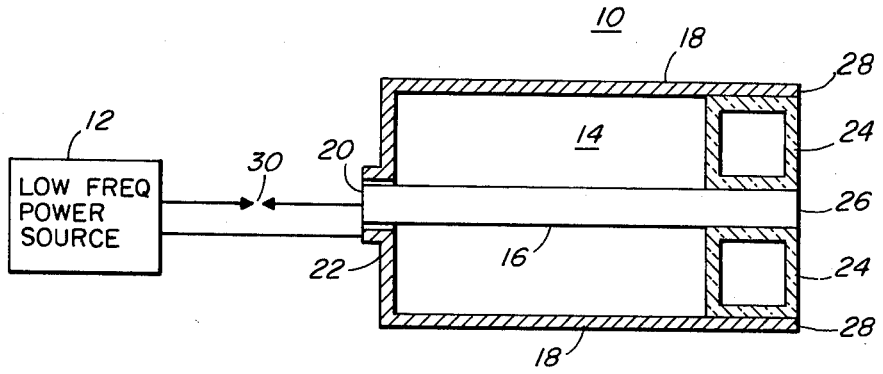
10
18
28
12
14
24
30
20
LOW FREQ
POWER
SOURCE
26
16
22
24
28
18

DC POWERED MICROWAVE DISCHARGE IN AN ELECTRODELESS LIGHT SOURCE

The present invention relates to an electrodeless light source and, more specifically, to one having a microwave discharge.

A microwave powered discharge is known to be capable of electrodeless operation having high luminous efficiency and long life. The discharge lamp itself has the advantage over lamps requiring filaments in simplicity, cost and freedom in choice of gas chemistry. However, the external microwave power source providing typically 40 watts of radio frequency power may be near the limiting high power level for most continuous duty semiconductor devices. In addition, the expense of a suitable microwave power source may be a factor in the development of the commercially useable electrodeless light source.

SUMMARY OF THE INVENTION

It is an object of the present invention to provide an intense light source operating in an electrodeless discharge mode.

An additional object of the present invention is to provide a radio frequency discharge lamp which does not require an external radio frequency source but which operates from a dc or low frequency ac power source.

A further object of the present invention is to provide a lamp which, itself, participates in the dc to rf conversion mechanism.

Still an additional object is to provide a source of light which is efficient and has a low manufacturing cost.

According to the present invention, there is provided a light source having a low frequency power source and a resonant device having an inner conductor and an outer conductor disposed around the inner conductor, the conductors having first ends coupled to the power source. An electrodeless lamp has an envelope made of a light-transmitting material and a fill material which emits light upon breakdown and excitation. The lamp is disposed at a second end of the conductors in the region therebetween. The fill material, in response to a low frequency electric field build-up to predetermined level, breaks down to produce repetitive exponentially damped bursts of radio frequency oscillations within the fill material to produce light.

BRIEF DESCRIPTION OF THE DRAWING

In the Drawing:

The sole FIGURE is a sectional view of a resonant cavity for use in electrodeless light source according to the present invention.

DESCRIPTION OF THE PREFERRED EMBODIMENT

In an exemplary embodiment of the present invention, as illustrated in the drawing, there is provided a light source, represented generally by the reference numeral 10. The light source includes a low frequency power source 12. A resonant device 14 has an inner conductor 16 and an outer conductor 18 disposed around the inner conductor 16. The conductors 16 and 18 have first ends 20 and 22, respectively, coupled to the power source 12. An electrodeless lamp 24 has an envelope made of a light-transmitting material, such as quartz, and a fill material which emits light upon breakdown and excitation. One suitable fill material is argon at a pressure from 0 to 5 torr and a suitable amount of mercury. The lamp 24 is disposed at second ends 26 and 28 of the inner and outer conductors 16 and 18, respectively. The fill material of the lamp 24 breaks down to produce repetitive exponentially damped bursts of radio frequency oscillations of current to produce light.

There are several additionally preferred features of the invention shown in the drawing. First, preferably the resonant device 14 is a cavity in which the length of the conductors 16 and 18 are equal to one-half the wavelength of the radio frequency oscillations. In the example shown, the radio frequency is approximately 1 GHz, thereby providing a cavity approximately 6 inches in length. Also, the power source preferably is a high voltage dc power source providing a voltage in the range of 3 to 10 kV. In addition, an external device is provided for rapidly charging the half wavelength resonant cavity. In the embodiment, this feature is carried out by an external spark gap represented generally by the reference numeral 30. The lamp 24 is illustrated as a toroid so as to fill the entire region between the inner and outer conductors at the second end of the conductors.

In the present invention, it has been found that the principle of the Hertzian generator may be applied to the development of an electrodeless light source. A simple microwave generation scheme is the Hertzian generator in which energy is repetitively stored in a resonant device such as a cavity and subsequently converted to microwave power at the frequency determined by the cavity. The switch required to perform the discharge function usually resides within the cavity. The properties of the switch must be such that a high impedance is presented to high voltage placed on the inner conductor, and upon closure, the impedance must fall to provide an effective short circuit to microwave oscillations in the cavity. In order to fulfill its dual role as an energy storage and resonant structure device, the cavity is preferably designed to support the lowest TEM mode of oscillation, i.e., $E_r$, $H_\theta$ components of the electromagnetic field will exist. The simplest mode in a cavity with low impedance termination is one supporting one-half wavelength oscillations. In operation, the Hertzian generator provides short bursts of microwave pulses having an envelope of the form of a damped exponential, the damping arising from conductivity losses in the walls of the cavity, extraction of microwave power to the external circuit and losses due to ionization, excitation and thermal processes taking place in the spark discharge. For additional details, reference may be made to U.S. Pat. to Cronson, No. 3,748,528, which is incorporated by reference.

In the present invention, the spark gap switch of the Hertzian device is replaced with an electrodeless gas discharge lamp 24 as illustrated in the drawing. Upon breakdown of the lamp fill material, the rf current will flow radially through the discharge and then along the conducting coaxial members of the cavity. Reflections will take place at a powered coupled end with phase reversal owing to the relatively low rf impedance presented by the high capacitance between electrodes at that point. In this manner rf oscillations will develop in the cavity following each inital breakdown of the plasma in the lamp. The rf waveform will generally be of damped exponential form occurring at the repetition rate of the initial breakdowns. In effect, the rf oscillations will boost the coupling of energy to the lamp since the dc energy would otherwise be blocked by the charge build-up on the lamp walls. With oscillations produced by the lamp, it may be possible to convert most of the inital dc energy to useful rf ocsillations in this way.

The embodiment of the present invention is intended to be merely exemplary and those skilled in the art shall be able to make numerous variations and modifications of it without departing from the spirit and scope of the present invention. For example, it may be desirable to shape the lamp 24 so as to fill substantially the entire region between the conductors. Also, while a spark gap 30 is shown for rapidly charging the cavity, an autotransformer with low voltage primary switching could also be used. Further, the basic concept of the invention could take many forms and could, for example, utilize lumped circuit elements. All such variations and modifications are intended to be within the scope of the present invention as defined by the appended claims.

We claim:

1. A light source comprising:

a. a low frequency power source, b. a resonant device having an inner conductor and an outer conductor disposed around the inner conductor, the conductors having first ends coupled to the power source, c. an electrodeless lamp having an envelope made of a light-transmitting material and a fill material which emits light upon breakdown and excitation, the lamp being disposed at a second end of the conductors in the region therebetween, the fill material, in response to a low frequency electrical field build-up to a predetermined level, breaking down to produce repetitive exponentially damped bursts of radio frequency oscillations of current within the fill material to produce light, and d. means external to the device for rapidly charging the resonant device.

2. The light source according to claim 1 wherein the resonant device is a cavity in which the length of the conductors are equal to one-half the wavelength of the radio frequency oscillations.

3. The light source according to claim 1 wherein the power source is a dc power source providing a dc voltage in the range of 3 to 10 kV.

4. The light source according to claim 1 wherein the charging means is a spark gap disposed between the power coupling and the power source and the first ends of the conductors.

5. The light source according to claim 1 wherein the lamp is shaped in the form of a toroid.

6. The light source according to claim 5 wherein the lamp is shaped so as to substantially fill the region between the inner and outer conductors.

* * * * *